US005141200A

United States Patent [19]

Sherman et al.

[11] Patent Number: 5,141,200

[45] Date of Patent: Aug. 25, 1992

[54] BLANKET HOLD DOWN DEVICE

[76] Inventors: Ronald Sherman, 19330 Frechton Pl.; Raymond M. Pierson, 9727 Shadow Oak Dr., both of Gaithersburg, Md. 20879

[21] Appl. No.: 650,386

[22] Filed: Feb. 4, 1991

[51] Int. Cl.[5] ..... A47B 97/00

[52] U.S. Cl. ..... 248/500

[58] Field of Search ..... 248/500, 508, 545, 156, 248/205.2, 910; 5/417, 441, 482, 466

[56] References Cited

U.S. PATENT DOCUMENTS

| | | | |
|---|---|---|---|
| 2,450,927 | 10/1948 | Allen | 248/105 |
| 2,651,485 | 9/1953 | Schutz | 248/102 |
| 2,792,576 | 5/1957 | Coady | 5/441 X |
| 4,060,863 | 12/1977 | Craig | 5/441 |
| 4,546,507 | 10/1985 | Weinstein | 5/417 X |
| 4,783,120 | 11/1988 | Kiechler | 5/462 X |
| 4,956,928 | 9/1990 | Lehrman | 248/205.2 X |
| 4,970,741 | 11/1990 | Spina | 5/417 |
| 4,980,935 | 1/1991 | Kazanowski et al. | 5/417 X |
| 4,980,939 | 1/1991 | Smith | 5/466 X |

FOREIGN PATENT DOCUMENTS

| | | | |
|---|---|---|---|
| 2400873 | 4/1979 | France | 5/417 |

*Primary Examiner*—Alvin C. Chin-Shue

*Attorney, Agent, or Firm*—Sughrue, Mion, Zinn, Macpeak & Seas

[57] ABSTRACT

A blanket hold down device is formed from two plies of fabric stitched together about their edges with an open portion secured together by detachable closure elements to facilitate the insertion and removal of weighting material. A strap is provided on one surface of the hold down device for engaging and holding a corner of a blanket or the like and a security pocket is secured to the opposite surface of the hold down device. An apertured tab is also secured to an edge of the hold down device for the reception of a hold down stake.

1 Claim, 2 Drawing Sheets

BLANKET HOLD DOWN DEVICE

BACKGROUND OF THE INVENTION

The present invention is directed to a blanket hold down device adapted to hold a blanket to prevent disarrangement of the blanket by wind or the like.

When people wish to sunbathe or have a picnic, it is quite common to spread a blanket on the ground so as to prevent contact between the person and the ground or with the person and sand on the beach. In order to prevent the blanket from being blown by the wind or otherwise disturbed, various objects which are handy are placed on the corners of the blanket. However, suitable objects for holding the blanket down are not always available. Valuable objects such as purses or functional objects such as shoes cannot always be left behind when a person leaves the blanket. In general, there are very few available devices which are specifically designed to hold down the corners of a blanket.

The U.S. Pat. No. 3,862,876 to Graves discloses a protective cloth cover having continuous flexible weights secured along two opposed edges to prevent the disarrangement of the cloth cover by wind or other extraneous forces. The opposed edges of the cover cloth ar folded back along themselves and are sewn to form an elongated pocket which is filled with a granular weighting material.

The U.S. Pat. No. 4,682,447 to Osborn discloses a tarpaulin having detachable weighting devices comprised of a hollow, plastic member adapted to be fitted with suitable weighting material such as sand or water. However, it is necessary to have an aperture in the tarpaulin in order to attach the weighting member.

The U.S. Pat. No. 4,634,618 to Greer discusses a weighted towel having a weighted cord stitched within the hem of the towel about the entire periphery thereof.

The U.S. Pat. Nos. 2,647,718 to Disera, 2,840,092 to Hill and 2,939,468 to Boyce all disclose peg-type hold down devices for blankets and the like.

SUMMARY OF THE INVENTION

The present invention provides a new and improved blanket hold down device having a simpler and more compact design than the above mentioned devices which can be easily attached to and detached from any blanket or merely placed on the corners of the blanket to hold the same in the desired spread condition.

The present invention provides a new and improved blanket hold down device having a closable compartment for receiving weighting material as well as a closable compartment adapted to hold valuables or the like in a hidden manner when the blanket hold down device is operably associated with a corner of a blanket.

The present invention provides a new and improved blanket hold down device comprising two-ply assembly of flexible material having a substantially L-shaped configuration, stitching means securing said two-ply assembly along respective peripheral edges except for a predetermined length, detachable connecting means secured to said peripheral edges along said predetermined length for detachably closing said compartment, pocket means secured to one surface of said two-ply assembly and having detachable closing means for closing said pocket and blanket engaging means secured to an opposite surface of said two-ply assembly for engaging and holding a corner of a blanket.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
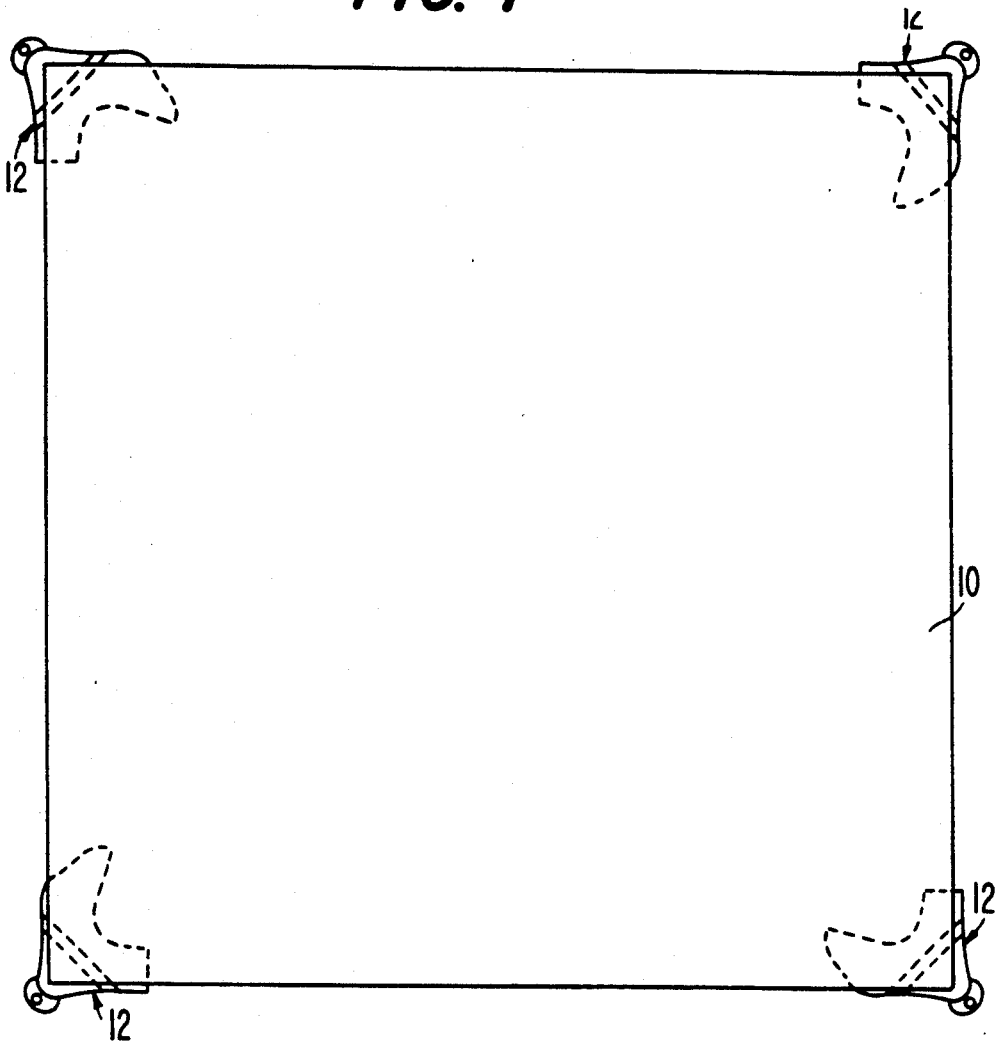
FIG. 1 is a plan view of a blanket having four hold down devices disposed in each corner thereof.

A blanket 10 is shown in FIG. 1 in the spread condition with a blanket hold down device 12 according to the present invention disposed at each corner of the blanket for securing the blanket against extraneous forces such as wind and the like.

Figure 3:
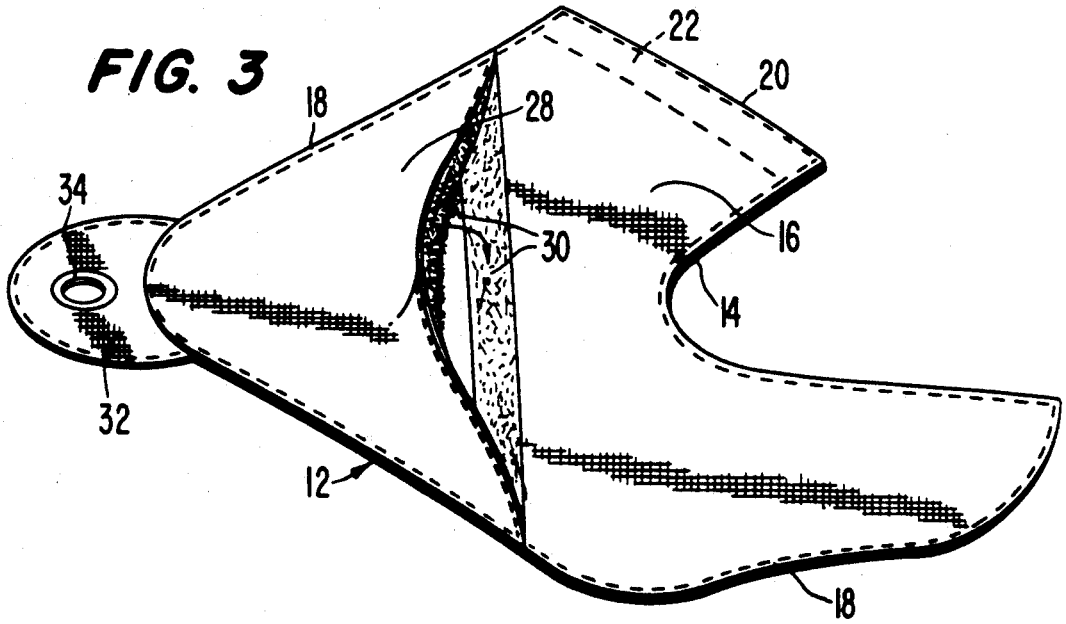
FIG. 3 is a perspective exploded view of an opposite side of the hold down device according to the present invention with a blanket and an anchor.
Figure 2:
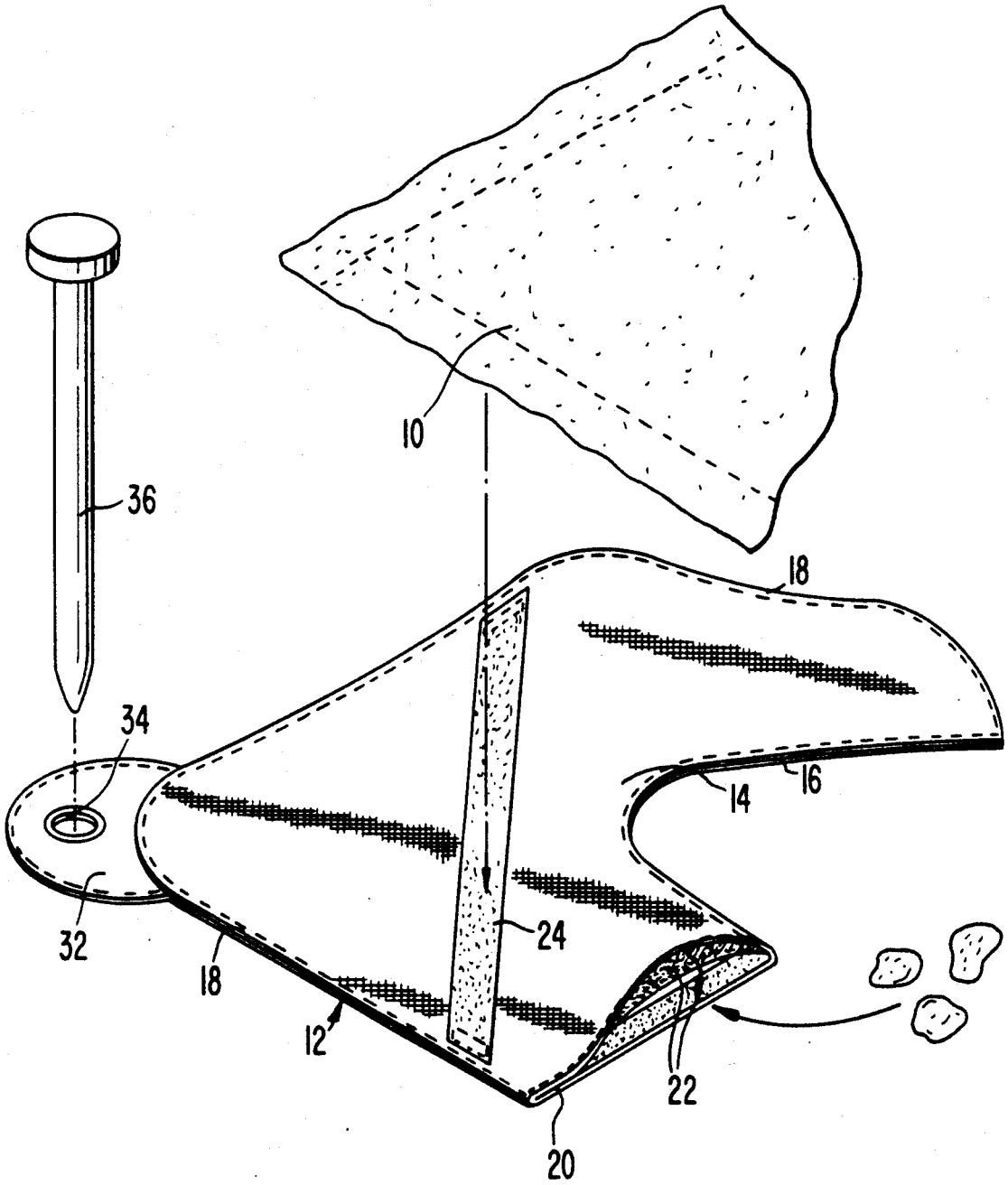
FIG. 2 is a perspective view of one side of a blanket hold down device according to the present invention.

The blanket hold down device according to the present invention is shown in detail in FIGS. 2 and 3 and is comprised of two plies of fabric 14 and 16 having a substantially L-shaped configuration. The plies 14 and 16 are stitched to each other along the peripheral edges 18 to form a compartment adapted to receive sand, gravel or any other suitable material for weighting down the device. An end portion 20 of the two-ply assembly 14, 16 is not stitched and forms an opening through which the weighting material may be placed into an removed from the compartment. Two complementary velcro strips are sewn to the respective plies 14 and 16 along the edges of the end portion 20 to provide for the closure of the compartment after it is filled with weighting material.

On the external surface of the ply 14, a velcro strip 24 of the type having a plurality of hook-like members is stitched to the opposite ends thereof. Many blankets are formed from woven or non-woven fibers which present a napped surface which ca readily be engaged by the hooks of the velcro-type fastener by pressing the blanket material downwardly upon the strip 24 in the position shown in FIG. 1. Thus, the corners of the blanket will be detachably secured to the hold down device. In the event the nature of the fabric comprising the blanket is such that a surface is not readily engageable by the hook-type fastener, the corner of the blanket can merely be tucked under the strap 24, which extends diagonally across the corner of the L-shaped hold down device. It is also possible to merely spread the blanket on the ground and place one of the hold down devices 12 on the upper surface of each corner of the blanket to hold down each corner of the blanket.

Although the weight of the hold down device when it is filled with sand, rocks or the like will be sufficient to hold the device in the desired position on the ground, additional securement means can be provided. A tab 32 is stitched between the two plies 14 and 16 of the hold down device at the corner thereof. A hole is formed in the tab and a grommet 34 is secured in the hole. A headed spike 36 can then be driven through the hole into the ground with the head engaging the grommet 34 to anchor the hold down device in a fixed position.

A security pocket for the reception of valuables or the like is provided on the side of the hold down device 12 opposite the blanket engaging strip 24. The pocket is comprised of a substantially triangular piece of material 28 which overlies the ply 16 of the hold down device and is secured by the peripheral stitching 18 which secures the plies 14 and 16 together. The free edge of the triangular fabric piece 28 is provided with a velcro strip 30 and a complementary velcro strip 30 is secured on the surface of the fabric ply 16. Thus, the valuables can be inserted into the pocket and the velcro strips 30 secured together to close the pocket. When the blanket hold down device is disposed in the operative position as shown in FIG. 1, the security pocket will be on the underside of the device so that it will not be visible.

While the hold down device can be constructed in the manner described above, it is obvious that various changes in form and details may be made. For example, the overall configuration of the hold down device can be varied and different types of fasteners can be substituted for the velcro fasteners. Likewise, the hold down device can be used to anchor other types of flexible sheeting such as tarpaulins, plastic sheeting and the like.

While the invention has been particularly shown and described with reference to preferred embodiments thereof, it will be understood by those in the art that the foregoing an other changes in form and details may be made therein without departing from the spirit and scope of the invention.

What is claimed is:

1. A blanket hold down device comprising:

a two-ply assembly of flexible material having peripheral edges secured together by stitching along substantially the entire periphery with the exception of the predetermined length thereof to define a compartment adapted to receive material for weighing down the device, closure means comprised of two complementary VELCRO strips secured along said length on each ply of said two-ply assembly to provide a readily openable and closable aperture, strap means secured at opposite ends to an outer surface of one ply of said two-ply assembly in overlying relation to said one ply for engaging and holding a corner of a blanket by inserting a corner of a blanket between said strap means and said one ply, and pocket means secured to an outer surface of a second ply of said two-ply assembly for receiving valuables.

* * * * *